United States Patent [19]

Griffith

[11] Patent Number: 4,901,998

[45] Date of Patent: Feb. 20, 1990

[54] MULTI-FUNCTIONAL ACTIVITY TABLE

[76] Inventor: Betty L. Griffith, 507 Nelson Ferry Rd., Decatur, Ga. 30030

[21] Appl. No.: 327,683

[22] Filed: Mar. 23, 1989

[51] Int. Cl.[4] ..... A63G 31/00

[52] U.S. Cl. ..... 272/1 A; 272/1 R; 108/150; 446/71

[58] Field of Search ..... 272/1 R, 1 A; 108/13, 108/150, 151; 446/69, 71, 73, 476

[56] References Cited

U.S. PATENT DOCUMENTS

| | | | |
|---|---|---|---|
| 139,805 | 6/1873 | Morrison | 108/13 X |
| 3,454,272 | 7/1969 | Elkington et al. | 272/1 A |
| 3,850,117 | 11/1974 | Martinelli | 128/150 |
| 3,886,607 | 6/1975 | Dunn | 272/1 R X |
| 4,428,305 | 1/1984 | Creske | 128/150 |

*Primary Examiner*—Richard E. Chilcot, Jr.
*Attorney, Agent, or Firm*—Harry I. Leon

[57] ABSTRACT

A multi-functional activity table to be used as a play/-learning tool for children of all ages. The apparatus comprises three main components including a table top, pedestal and domed base, each of which can be employed separately or in combination with one or more of the others for a child's amusement and instruction. The apparatus is easily converted into the following: art table, water table, sandbox, rocker, toss game, crawl-through and tee ball toy. The apparatus not only represents a substantial saving in cost over that which would be required to acquire an individual toy for each activity but also has nesting features which allow one to store the apparatus in much less space than would be possible with equipment designed only for each individual game. Furthermore, the multi-functional activity table offers many attractive features not available with single game-type apparatus. In particular, children themselves derive much pleasure from transforming the apparatus as they play with it in first one activity and then another.

12 Claims, 4 Drawing Sheets

Fig. 3.
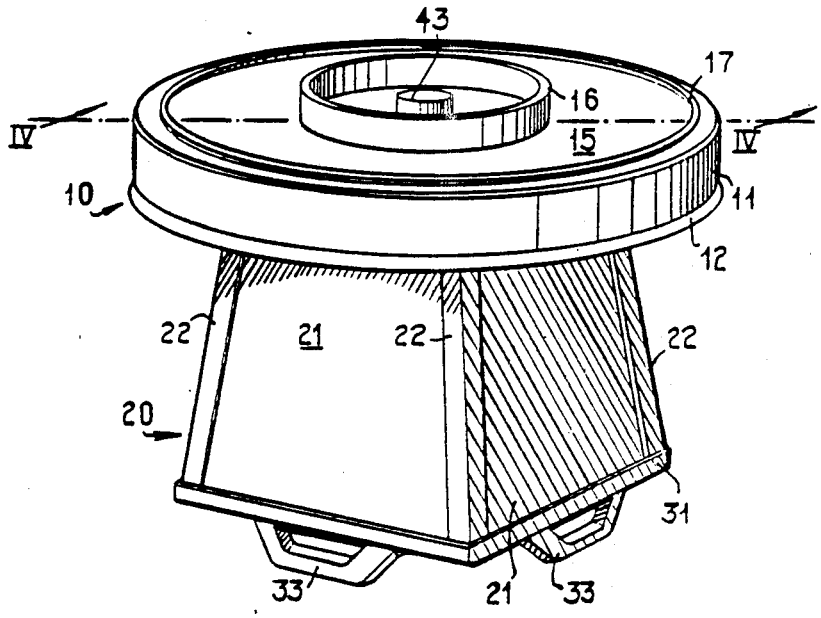
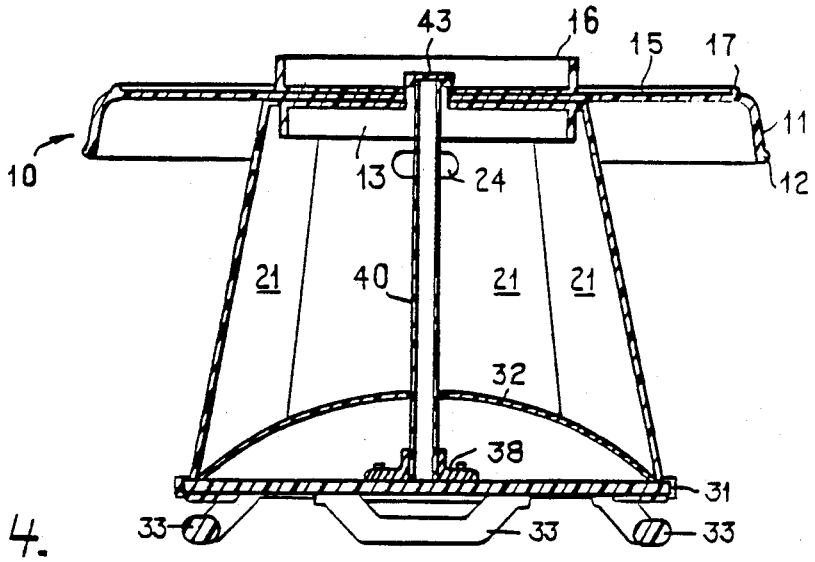
Fig. 4.

Fig. 5.
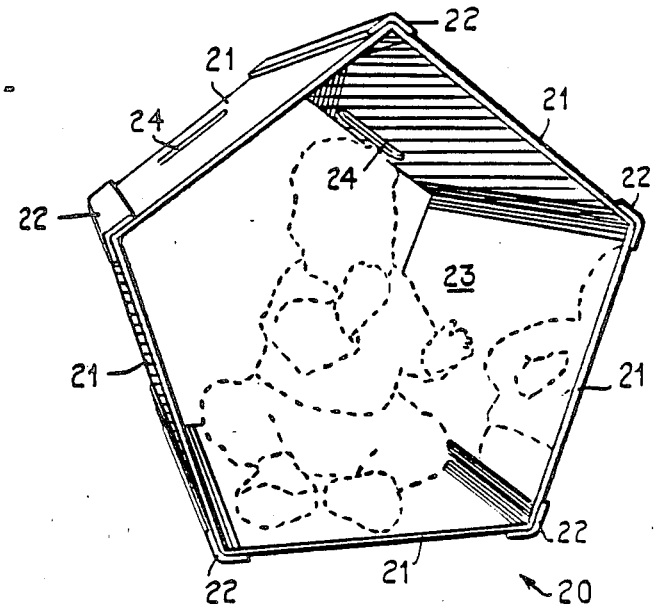
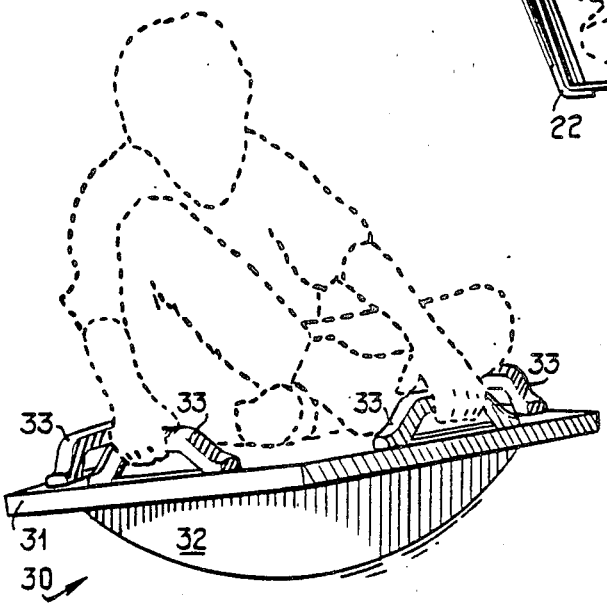
Fig. 6.
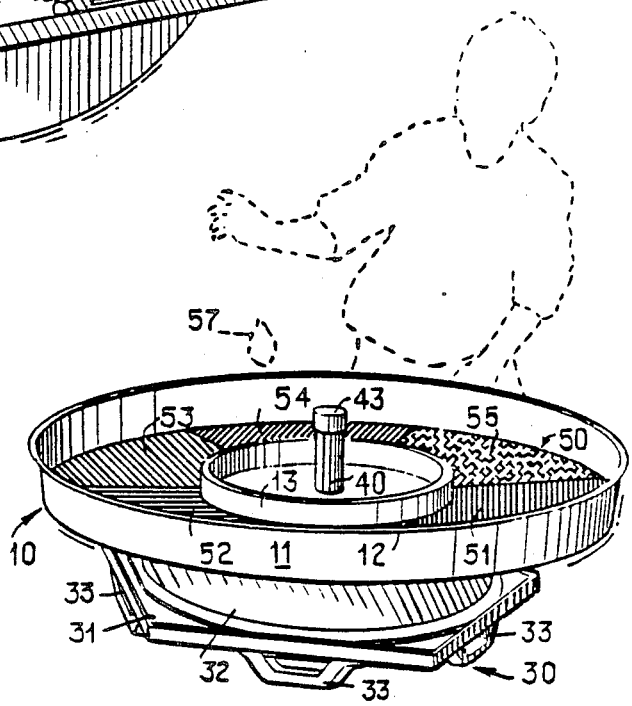
Fig. 7.

Fig. 8.
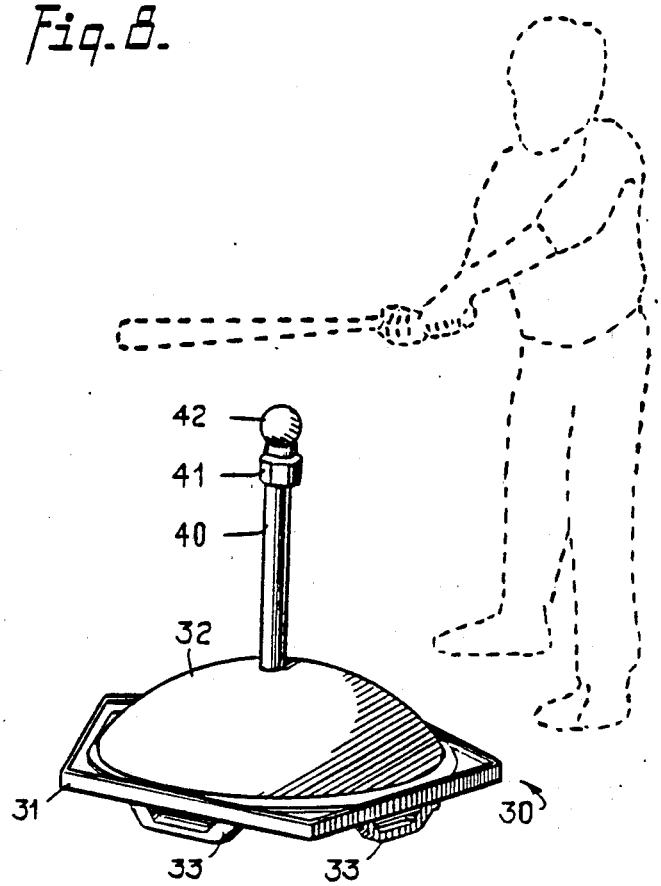
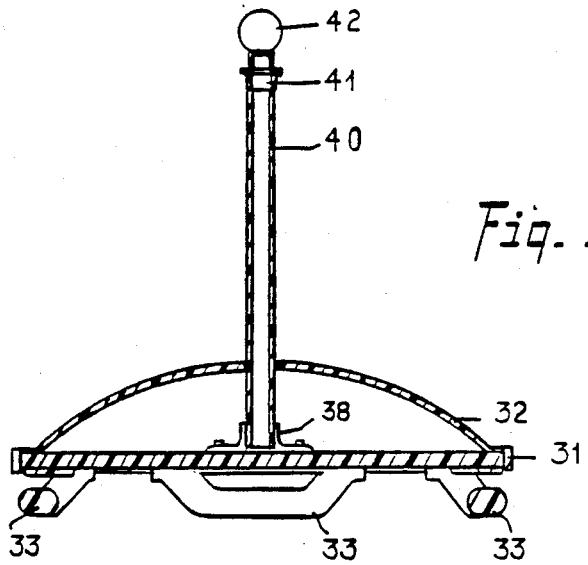
Fig. 9.

MULTI-FUNCTIONAL ACTIVITY TABLE

BACKGROUND OF THE INVENTION

This invention relates generally to tables and amusement and exercising devices. Conventional tables comprise a table top and support therefor, the support generally comprising a plurality of legs or a central pedestal. A table with a pedestal which serves more than one function is taught by Weber, U.S. Pat. No. 3,683,824. Weber utilized common objects such as a 55-gallon drum or a barrel as a pedestal for an inexpensive table with a central garbage receptacle for picnic or patio use. Weber, however, did not try to use the pedestal in any other mode. Creske, U.S. Pat. No. 4,428,305, likewise utilized a 55-gallon drum as a table top support/receptacle.

Elkington and Rekow, U.S. Pat. No. 3,454,272, realized the advantages of having a circular elevated sandbox and play pen. Williams and Williams, U.S. Pat. No. 3,006,705, showed a clever design for a combination table, sandbox and wading pool.

Hilliker, U.S. Pat. No. 2,615,495; Gehrke and Camuso, U.S. Pat. No. 3,586,321; and Winchester, U.S. Pat. No. 2,878,858, all realized the enjoyment and helpful exercise one can obtain from using a bowl-shaped rocker toy.

Clark, U.S. Pat. No, 1,917,018, realized the delight children experience from crawling through tunnel toys. Paczkowski, U.S. Pat. No. 3,730,522, disclosed a rocking toy with a tunnel.

While the above cited prior art discloses devices such as a table, water table, sandbox, rocker toy, and tunnel toy, none of these previously patented devices can be transformed easily from any one of these items into each and every other one of them.

SUMMARY OF THE INVENTION

In the simplest form, I have provided a table having a central pedestal. The top of the table, which is reversible, comprises a curved outer wall, a generally flat section which extends inwardly from this outer wall, and means including a pair of annular collars which project in opposite directions from the flat section for detachably mounting the table top on the pedestal. When the table top is mounted so that its outer wall extends upwardly from the flat section, giving the top a dished shape, a region of the top disposed between the outer wall and the then uppermost annular ring can be used to hold water. Alternately, this region may be filled with sand or may just be left as a spill-proof play area about which toys or the like can be rolled. The reverse side of the table has a large generally smooth surface which extends laterally from the other annular collar and upon which a child can do flat art work or other activities suitable for doing on an elevated, generally flat surface. The table top can also be removed from the pedestal and used by itself as a sandbox or as a water and mud-holding toy.

In the preferred embodiment, the walls of the pedestal form the sides of a frustrum of a regular pyramid. Moreover, the pedestal has a through passageway which is slightly larger in transverse cross-sectional area than is the space surrounded by either of the two annular collars. Further, this passageway is large enough that a child can use the pedestal as a crawl-through tunnel toy or as a hide-away. The height of the table top with only the pedestal as support is low enough that the table can be used by younger children.

In addition to the pedestal, the support for the table, when used at its full height, comprises a base and means including a tube for locking the table top to the base. The base itself has a flat slab and a domed wall secured thereto, the domed wall being insertable into the lower end of the through passageway of the pedestal. The tube, which is anchored to a fitting mounted on the base, extends longitudinally through the passageway of the pedestal and into a hole formed in the flat section of the table top.

A host of games can be played with individual components of the apparatus as well as with combinations of these components. The base, for example, is usable in two modes. In the upright position, the base with the tube anchored thereto can be used in a ring toss game or for tee ball. When the tube is removed and the base turned over, the base, with a portion of the domed wall resting on the ground and with its flat slab providing a platform on which a person can sit or ride, becomes a rocker toy.

The table top can also be mounted on the base without the pedestal. One such combination includes the top being rotatably mounted with the tube serving as a shaft and with the top resting on the domed wall of the base when the top is not in motion. When the top is so mounted and its curved outer wall extends upwardly, creating a dished apperance, a target having a plurality of truncated pie-like segments of various colors can be held inside the table top even as it is rotated about the tube. A toss game in which a bean bag is thrown onto the target as the top is turned on the shaft can then be played.

When the curved outer wall of the top extends downwardly, on the other hand, the base alone can again serve as the sole support for the table top. The latter configuration finds application in the activities of very young children or the severely handicapped.

The games which can be played with the device according to the present invention are not limited to those described herein. Indeed, the many facets of this application allow the teacher and the children to be creative. Even when not in use, the pedestal mounted on the base is useful as a storage bin. The parts of the apparatus are sufficiently lightweight that even two small children working together can carry and assemble the various embodiments. Furthermore, the table is equipped with plastic feet so that it slides easily and may be moved about with little effort.

BRIEF DESCRIPTION OF THE DRAWINGS

FIG. 3 is a perspective view showing the apparatus in the art table configuration;

FIG. 4 is a cross-section IV—IV from FIG. 3;

FIG. 5 is a perspective view showing the pedestal of the apparatus according to FIG. 1 used as a tunnel toy;

FIG. 6 is a perspective view showing the base of the apparatus according to FIG. 1 used as a rocker toy;

FIG. 7 is a perspective view of the base and the table top of the apparatus according to FIG. 1 used as a toss game;

FIG. 8 is a perspective view of the base and the tube of the apparatus according to FIG. 2 used for a tee ball game; and FIG. 9 is an elevational cross-sectional view showing the base and tube according to FIG. 8.

DESCRIPTION OF THE PREFERRED EMBODIMENT

Figure 1:
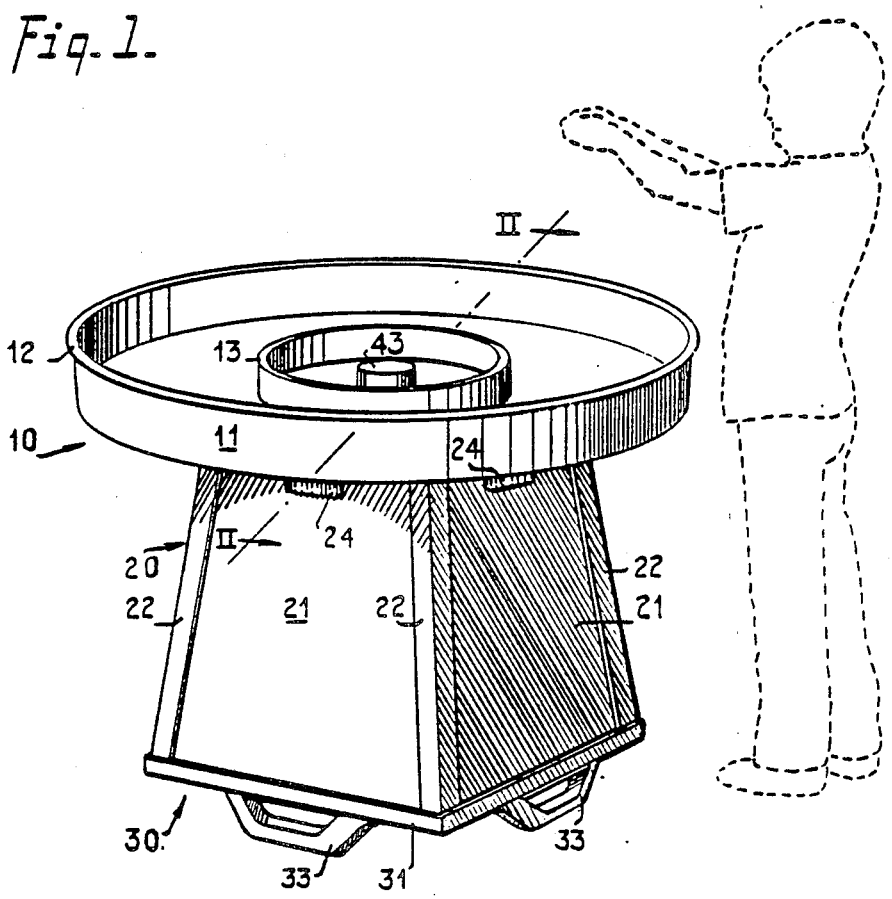
FIG. 1 is perspective view showing the apparatus in the sand-water table configuration.

Referring now to the figures, the apparatus includes three main components: a table top, a pedestal and a base, which are indicated generally by the reference numerals 10, 20, and 30, respectively.

Figure 2:
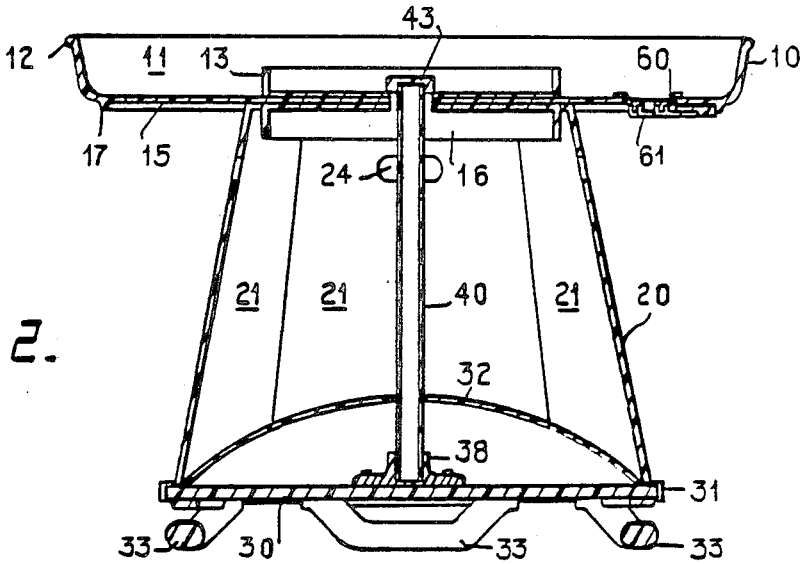
FIG. 2 is cross-section II—II from FIG. 1.

One of the many modes in which the apparatus may be used is as a sand-water table (FIG. 1). As shown in FIGS. 1 and 2, the table top 10 includes a flat section which measures, by way of example, about 40 inches in diameter and an outer side wall 11 which terminates in a slightly rolled lip 12 which is provided to retain splash and backwash and at the same time to make the edge of the side wall safer for small children. In addition to the side wall 11, a pair of annular collars 13, 16, each of which measures about 2 inches in height and about 17½ inches in diameter, project from opposite sides of the flat section. A cavity formed by the flat section, the annular collar 13 and the outer side wall 11 can be used to hold water. Inwardly of this cavity, the flat section and the annular collar 13 comprise a receptacle for sand, water toys and the like.

As shown in FIGS. 2 and 4, the outside diameter of the collar 13, 16 is slightly smaller than the inside width of an opening in the top of the pedestal 20 so that the collar can be slid with a light force fit into the top opening in the pedestal to help support the table top 10. The collar 16 is employed to so support the top 10 when the surface 15 thereon is down as shown in FIGS. 1 and 2, and the collar 13 is used to stabilize the top when the surface 15 is up (FIGS. 3 and 4).

In the preferred embodiment, the top 10 also comprises a removable plug 60 to facilitate removing sand from the cavity in the top. Within the plug 60, there is also a smaller plug 61 which may be removed independently of the remainder of the plug 60 whenever it is desirable just to drain water by itself from the top 10 (FIG. 2).

When the top 10 is mounted with the flat surface 15 up as shown in FIG. 3, the annular collar 16, which is otherwise employed to support the top while it is in the water table configuration (FIG. 1), now is used to hold materials such as children's art supplies or games. In the preferred embodiment, the flat surface is bounded outwardly by a small ridge 17 which tends to prevent such objects from falling off of the table 10. The ridge 17 preferably has a rounded edge and is approximately ¼ inch in height.

As illustrated in FIGS. 1 through 5, the pedestal 20 comprises five side panels 21 joined together and reinforced by corner stiffeners 22 to form a pentagonal frustum which measures, by way of example, approximately 20 inches in height and which has upper and base widths measuring about 20 and 27½ inches, respectively. Each of the panels 21 preferably has a handle hold 24 formed therein. Alternately, the pedestal can be molded as a one piece structure (not shown).

In the preferred embodiment, both the top 10 and the pedestal 20 are fabricated from plastic which is about ¼ inch thick.

The pedestal 20 may even be used by itself as a crawl-through apparatus or as a play house as shown in FIG. 5. The inside surface of the pedestal 20 is preferrably covered with a reflective vinyl material 23 which provides a mirrored surface to add extra enjoyment for the children.

A base 30 for the pedestal 20 of the table 10 may be employed to raise the table height about 4 inches. The base 30 comprises a domed wall 32 and a generally flat slab 31 rigidly joined thereto along the periphery of the domed wall, the slab being preferably pentagonal in shape and measuring, by way of example, about 28 inches in width. The domed wall 32 includes a flange which extends outwardly from the edges of a generally spherical segment. The spherical segment measures, by way of example, about 6 inches in height and is sized to fit in the inside of the pedestal 20 (FIGS. 2 and 4). The base 30 further comprises five feet 33 that are shaped as handles and which project from the slab 31 on the side thereof disposed opposite the domed wall 32.

In addition to its usefulness in raising the height of the table 10, the base 30 provides means for anchoring a tube 40 which in the preferred embodiment extends the length of the pedestal 20 through a central hole formed in the table top 10. The anchoring means comprises a standard pipe-threaded fitting 38 rigidly attached to the slab 31 for threadedly engaging one end of the tube 40. A cap 43 can be used to threadedly engage the other end of the tube 40. When the cap 43 is tightened sufficiently, contiguous faces of the cap, the top 10, the pedestal 20, and the base 30 are pressed together, forming a secure structure.

The base 30, without the pedestal 20, is also useful for playing several games. The base 30 may be turned over and used as a rocker toy in either the standing or seated position as shown in FIG. 6. In such a play mode, the feet 33 serves as handles. In yet another game, the base 30 and the tube 40 can be used together as a tee ball support as shown in FIGS. 8 and 9. The tube 40 is preferably a section of 1½ inch PVC pipe to which is attached a ball support 41 for readying a tee ball 42. In this configuration, the tube 40 supported by the base 30 can be utilized for a game of ring toss. With a longer tube (not shown), a game of tether ball can be played. Alternately, a longer tube (not shown) having holes therethrough for receiving hooks on which to hang toys or the like may be mounted on the base 30 to form a storage rack or toy tree.

In a configuration for still yet another game, the top 10 is placed directly on the base 30 and is rotatably held there by the tube 40 (FIG. 7). In this play mode, a suitable target 50, fabricated of variously colored, truncated pie-shape segments 51–55 made of felt or the like, can be held between the outer side wall 11 and the proximate annular collar 13. A child can then toss a bean bag 57 at the target 50 as it is being rotated (FIG. 7).

It is claimed:

1. A multi-functional activity table comprising:

(a) a reversible top having a generally flat section with a hole formed therein and a pair of annular collars which surround the hole, the collars projecting from the flat section in opposite directions relative to each other;

(b) a pedestal that is in the form of a hollow frustrum of a regular pyramid, the pedestal having a through passageway which extends the length of the pedestal; the minimum width of a transverse cross-section of the passageway at a first end thereof being slightly greater than the outer diameter of each of the annular collars, so that each of the collars can be inserted into said first end of the pedestal;

(c) a base;

(d) an elongated structure;

(e) means connected to the base for anchoring the elongated structure thereto, the elongated structure extending upwardly along said passageway from the base and through the hole in the top; and (f) means detachably connected to the elongated structure above the hole for holding the top in a fixed relationship to the base.

2. The table according to claim 1 wherein the through passageway is further characterized as having a minimum transverse cross-sectional area which is large enough that a small child can crawl through the passageway when the pedestal is disposed generally horizontally.

3. The table according to claim 1 wherein the base is capable of forming a free-standing support for the elongated structure.

4. A multi-functional activity table comprising:

(a) a reversible top having a generally flat section with a first hole formed therein and at least one annular collar which surrounds the first hole; the collar projecting from the flat section;

(b) means including a base with a generally rounded member for supporting the top, the rounded member having a generally spherical segment which is disposed upwardly forming a dome; the dome having a second hole formed therein;

(c) an elongated structure with a cylindrical wall of less diameter than the first and second holes;

(d) means connected to the base for anchoring the elongated structure thereto, the cylindrical wall extending upwardly from the base and through the first and second holes, so that the top may be rotated about the cylindrical wall.

5. The table according to claim 4 which further comprises:

(a) a pedestal that is in the form of a hollow frustrum of a regular pyramid, the pedestal having a through passageway which extends the length of the pedestal; the minimum width of a transverse cross-section of the passageway at a first end thereof being slightly greater than the outer diameter of the annular collar, so that the collar can be inserted into said first end; the minimum width of a transverse cross-section of the passageway at a second end thereof being slightly greater than the greatest transverse width of the dome, so that the dome can be inserted into said second end; and (b) means detachably connected to the elongated structure above the first hole for holding the top in a fixed relationship to the base.

6. The table according to claim 5 wherein the through passageway is further characterized as having a minimum transverse cross-sectional area which is large enough that a small child can crawl through the passageway when the pedestal is disposed generally horizontally.

7. The table according to claim 4 which further comprises means secured to the upper end of the elongated structure for supporting a tee ball.

8. A multi-functional activity table comprising:

(a) a reversible top having a generally flat section with at least one annular collar which projects perpendicularly from the flat section; and (b) a pedestal that is in the form of a hollow frustrum of a regular pyramid, the pedestal having a through passageway which extends the length of the pedestal; the minimum width of a transverse cross-section of the passageway at a first end thereof being slightly greater than the outer diameter of the annular collar, so that the collar can be inserted into said first end.

9. The table according to claim 8 wherein the through passageway is further characterized as having a minimum transverse cross-sectional area which is large enough that a small child can crawl through the passageway when the pedestal is disposed generally horizontally.

10. The table according to claim 8 which further comprises means including a base with a generally rounded member, the rounded member having a generally spherical segment which is disposed upwardly forming a dome; the greatest transverse width of the dome being slightly less that the minimum width of a transverse cross-section of the passageway at a second end thereof, so that the dome can be inserted into said second end.

11. A table according to claim 10 wherein the rounded member further comprises a flange connected to the edges of the spherical segment and wherein the base further comprises a flat slab rigidly attached to the flange and a plurality of feed rigidly attached to the slab, the feet being usable as handles when the base is separated from the remainder of the table.

12. The table according to claim 8 which further comprises a curved outer wall which extends upwardly from the generally flat section; the curved outer wall, the generally flat section, and the annular collar forming a cavity which is capable of holding water.

* * * * *